United States Patent [19]

Matsubara

[11] 3,935,813

[45] Feb. 3, 1976

[54] PRINT HAMMER DEVICE

[75] Inventor: Toru Matsubara, Chofu, Japan

[73] Assignee: Tokyo Juki Kogyo Kabushiki Kaisha, Chofu, Japan

[22] Filed: Oct. 3, 1974

[21] Appl. No.: 511,728

[30] Foreign Application Priority Data

Oct. 11, 1973 Japan ..... 48-114100

[52] U.S. Cl. ..... 101/93.31; 101/93.48

[51] Int. Cl.² ..... B41J 9/36

[58] Field of Search ..... 101/93.29, 93.34, 93.48, 101/93.02

[56] References Cited

UNITED STATES PATENTS

| | | | |
|---|---|---|---|
| 3,587,456 | 6/1971 | Jaensch | 101/93.31 |
| 3,623,428 | 11/1971 | Imahashi | 101/93.31 |
| 3,648,602 | 3/1972 | Avgerinos | 101/93.31 |
| 3,673,956 | 7/1972 | Huber et al. | 101/93.31 |
| 3,710,713 | 1/1973 | Voegelin | 101/93.31 |
| 3,804,009 | 4/1974 | Blume | 101/93.02 X |
| 3,805,695 | 4/1974 | Babler | 101/93.48 X |

*Primary Examiner*—Edgar S. Burr
*Assistant Examiner*—Edward M. Coven
*Attorney, Agent, or Firm*—Wenderoth, Lind & Ponack

[57] ABSTRACT

A printing device is constituted by a common rotary printing drum having raised printing type faces; and a printing mechanism including a spring-loaded hammering member pivotal toward and away from the drum, a continuously driven pawled wheel, a spring-loaded rocking member pivotal between operative and inoperative positions, magnetic means for attracting and maintaining the rocking member to and in said inoperative position, a spring-loaded trigger hammer pivoted to the rocking member, an intermittently driven cam member opposed to the rocking member for engaging and disengaging from the rocking member and an engaging member opposed to the trigger hammer for engaging and disengaging from the trigger hammer.

1 Claim, 1 Drawing Figure

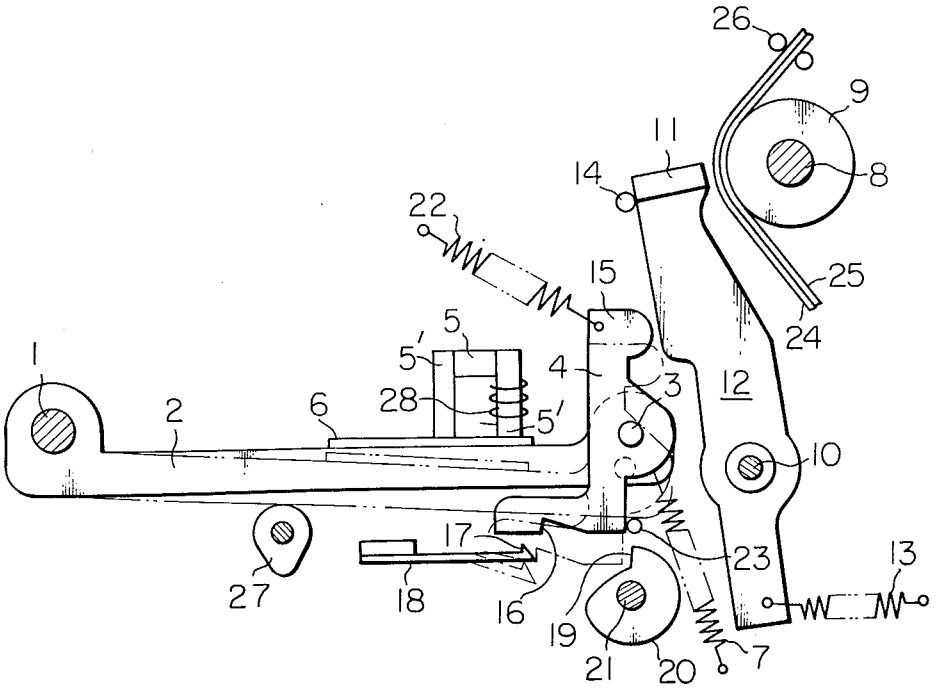
1
2
3
4
5
5'
5'
6
7
8
9
10
11
12
13
14
15
16
17
18
19
20
21
22
23
24
25
26
27
28

PRINT HAMMER DEVICE

BACKGROUND OF THE INVENTION

This invention relates to a printing device and more particularly, to a printing device of the line printer type which is compact and less expensive, which can effect printing at a high speed and which includes means for prevention of superimposed printing.

There have been proposed and practically employed a great variety of printing devices and one typical prior art printing device generally comprises a rocking member pivoted at one end to a shaft, magnet means for normally attracting and maintaining the rocking member inoperative, a spring anchored to the rocking member for acting to bias the rocking member away from the magnet means when the device is operated for printing, a trigger hammer pivoted to the other end of the rocking member and have a striking portion, a second spring anchored to the striking portion of the trigger hammer for normally biasing the trigger hammer to its inoperative position and a continuously rotating pawled wheel having a pawl for engaging and disengaging from the trigger hammer whereby when the magnet means is excited, the trigger hammer pivots to a position in which the trigger hammer lies within the rotation locus of the pawled wheel to engage or strike against the pawl of the pawled wheel so as to effect a printing operation. Thus, in the prior art printing device referred to above, since the magnet means is adapted to attract the rocking member thereto against the force of the spring which normally biases the rocking member away from the magnet means, the magnet means is required to have a substantially high magnetic force to attract the rocking member thereto against the force of the spring. Therefore, the magnetic means is inevitably massive and expensive. And since the magnetic means attracts the rocking member thereto, against the force of the spring which normally biases the rocking member away from the magnetic means, it requires a rather long time for attracting the rocking member which results in a slow printing operation. Furthermore, as long as the magnetic means continues to maintain its excited condition, since the trigger hammer lies in the rotation locus of the pawled wheel rotating continuously at a high speed even after one printing operation has been completed, the trigger hammer may repeatedly have delivered thereto a striking force by the rotating pawled wheel resulting in superimposed printing. The superimposed printing fails to provide clearcut printing.

SUMMARY OF THE INVENTION

Therefore, one object of the present invention is to provide a novel and improved printing device which can effectively eliminate the disadvantages referred to above.

Another object of the present invention is to provide a novel and improved printing device which includes a relatively small size magnetic means, which is compact and which can be produced at a relatively lower cost.

Another object of the present invention is to provide a novel and improved printing device which includes a permanent magnetic means adapted to normally attract and maintain a rocking member to and in its inoperative position when the device is not operated.

According to the present invention, there has been provided a printing device comprising in combination a common rotary printing drum having a plurality of raised type faces on the periphery thereof; and a printing mechanism including a spring-loaded hammering member mounted for pivotal movement toward and away from said drum and normally biased away from the drum, a continuously rotating pawled wheel having a pawl on the periphery; a spring-loaded rocking member pivoted at one end for pivotal movement between operative and inoperative positions; magnetic means for normally attracting and maintaining said rocking member to and in said inoperative position against the force acting to bias the rocking member to said operative position; a spring-loaded trigger hammer pivoted to the other end of the rocking member and normally biased away from said hammering member; an intermittently driven cam member mounted in a position opposed to said rocking member for engaging and disengaging from the rocking member, and an engaging member mounted in a position opposed to said trigger hammer for engaging and disengaging from the trigger hammer, whereby said magnetic means normally attracts and maintains said rocking member to and in said inoperative position so as to position said trigger hammer out of the rotation locus of said pawled wheel and away from said engaging member whereas when said magnetic means is demagnetized, said rocking member is allowed to pivot to the operative position so as to position said trigger hammer in said rotation locus of the pawled wheel into engagement with said pawled wheel to thereby cause said trigger member, hammering member and printing drum to cooperate with each other in effecting a printing operation and after the printing operation, said engaging member engages the trigger member to maintain the trigger member out of the rotation locus of the pawled wheel while the rocking member is being pivoted to said magnetic means by said cam member.

The above and other objects and attendant advantages of the present invention will be more readily apparent to those skilled in the art from a reading of the following description in conjunction with the accompanying drawing which shows one preferred embodiment of the invention for illustration purposes only, but not for limiting the scope of the same in any way.

BRIEF DESCRIPTION OF THE DRAWING

The sole FIGURE of the accompanying drawing is a fragmentary side elevational view of one preferred embodiment of printing device constructed in accordance with the present invention.

PREFERRED EMBODIMENT OF THE INVENTION

Referring to the sole FIGURE of the drawing, a rocking member 2 is pivoted at one end to a transverse shaft 1 which is in turn suitably supported in the machine frame of the printing device and the other end of the rocking member pivotally supports a trigger hammer 4 by means of a pin 3. A magnetic member 6 in the form of a thin magnetic plate is fixedly mounted on the upper surface of the rocking member 2 between the opposite ends of the latter to be normally attracted by yokes 5', 5' secured to a permanent magnet 5 which is in turn suitably supported on the machine frame (not shown). A coiled spring 7 is anchored at one end to the other end of the rocking member 2 and the other end of the spring is secured to the machine frame. The coiled spring 7 has a strength lower than the attractive force of the permanent magnet 5 and is adapted to counteract the attraction by the magnet 5. A printing drum 9 is rotatably supported on a transverse shaft 8 which extends parallel to the transverse shaft 1 to which the rocking member 2 is pivoted and is suitably supported in the machine frame. The printing drum 9 is formed of resilient material such as rubber and is connected to a suitable drive power source (not shown) to be driven thereby. The printing drum 9 is provided with a plurality of sets of raised type faces on the peripheral surface thereof. Disposed between the trigger hammer 4 and printing drum 9 is a hammering member 12 pivoted to a transverse shaft 10 which extends parallel to the shafts 1 and 8 and the hammering member has formed at the upper end a striking portion 11 in opposition to the printing drum 9 to strike against the latter when actuated. A coiled spring 13 is anchored at one end to the lower end portion of the hammering member 12 and has the other end anchored to the machine frame so as to normally bias the hammering member 12 in the counter-clockwise direction. A transverse stop 14 is suitably fixed to the machine frame in a position adjacent to the striking portion 11 to limit the rotation of the hammering member in the counter-clockwise direction. The trigger hammer 4 is formed in the shape of a reversed "L" and has an abutment 15 at the upper end of the vertical portion for abutting against the side of the hammering member 12 opposite from the printing drum 9 whereas the horizontal portion of the L-shaped trigger hammer 4 has formed on the underside a recess 16. A resilient engaging member 18 is fixedly secured to the machine frame and extends below the horizontal portion of the trigger hammer 4 for engaging and disengaging from the recess 16 in the trigger hammer 4. For the purpose, this engaging member 18 is provided at the right-hand end with a pointed upward projection 17. A pawled wheel 20 is fixedly supported on a transverse shaft 21 which is in turn suitably supported in the machine frame and extends parallel to the transverse shaft 10 in a position below the trigger hammer 4. The transverse shaft 21 is connected to the drive power source to be rotated thereby and the pawled wheel 20 is provided with a pawl 19. A coiled spring 22 is anchored at one end to the abutment 15 on the trigger hammer 4 and at the other end to the machine frame so as to normally urge the trigger hammer 4 about the pin 3 in the counter-clockwise direction. A stop pin 23 is suitably supported in the machine frame adjacent to the lower end of the trigger hammer 4 for engaging the trigger hammer so as to limit the movement of the trigger hammer in the counter-clockwise direction. When the trigger hammer 4 is engaged and its pivotal movement is stopped by the stop pin 23, the recess 16 is maintained in its disengaged position with respect to the projection 17 on the engaging member 18. A feed mechanism 26 is suitably connected to the drive power source (not shown) to be intermittently driven thereby so as to intermittently feed a paper sheet 24 and an inked ribbon 25 together in the passage defined between the printing drum 9 and hammering member 12 in proximity to the drum. A cam member 27 is suitably supported in the machine frame adjacent to the underside of the rocking member 2 for intermittent movement in synchronization with the intermittent movement of the feed mechanism 26. Reference numeral 28 denotes a release coil 28 wound about one of the yokes 5' for demagnetizing the permanent magnet 5.

The mutual operative relationship between the rocking member 2, trigger hammer 4, permanent magnet 5, hammering member 12, engaging member 18, pawled wheel 20 and cam member 27 is as follows: The rocking member 2 is normally attracted to the permanent magnet 5 by the magnetic member 6 on the rocking member so as to disengage the abutment 15 of the trigger hammer 4 and the recess 16 of the trigger hammer 4 from the hammering member 12 and the projection 17 on the engaging member 18, respectively, to thereby position the trigger hammer 4 out of the rotation locus of the pawled wheel 20 and also maintain the rocking member 2 away from the cam member 27. When the permanent magnet 5 is demagnetized upon the flow of current through the release coil 28, the force of the coiled spring 7 urges the rocking member 2 to pivot in the clockwise direction about the transverse shaft 1 until the rocking member contacts the cam member 27 whereupon the lower end of the trigger hammer 4 which is then disposed in the rotation locus of the continuously rotating pawled wheel 20 engages the pawl 19 on the wheel 20 to be pivoted thereby in the clockwise direction. The clockwise rotation of the trigger hammer 4 causes the hammering member 12 to strike against the printing drum 9 with the therebetween paper sheet 24 and ribbon 25 to thereby effect printing on the paper sheet 24. After the printing operation, the projection 17 on the engaging member 18 is engaged by the recess 16 in the trigger hammer 4 to lock the trigger hammer out of the rotation locus of the pawled wheel 20. Thereafter, when the cam member 27 rotates intermittently in synchronization with the intermittent operation of the feed mechanism 26, the rocking member 2 pivots in the counter-clockwise direction about the transverse shaft 1 toward the permanent magnet 5 so as to disengage the recess 16 in the trigger hammer 4 from the projection 17 on the engaging member 18 to thereby return the various parts of the device to their respective initial positions prior to the printing operation.

According to the present invention, a desired number of rocking members and a corresponding number of hammering members which correspond to the above-mentioned rocking member 2 and hammering member 12, respectively are provided on the common transverse shafts 1 and 10, respectively. The permanent magnet 5 and cam member 27 are provided for cooperation with each of the rocking members and the engaging members 18 with the projections 17 are also provided for cooperation with each trigger hammer 4.

With the above construction and arrangement of the parts of the printing device of the invention, when the printing device is not used or operated, the rotating cam member 27 is maintained in its stopped position as indicated by the full line and the permanent magnet 5 attracts and maintains the rocking member 2 to and in the full line position as shown in cooperation with the magnetic member 6 on the rocking member against the force of the coiled spring 7. Therefore, the lower end of the trigger hammer 4 which is adapted to pivot in the counter-clockwise direction about the pin 3 under the force of the coiled spring 22 until the trigger hammer engages the pin 23 is disposed out of the rotation locus of the pawled wheel 20 and the recess 16 in the trigger hammer is positioned above and away from the projection 17 on the engaging member 18. Thus, the abutment 15 on the trigger hammer 4 is separated from the hammering member 12 and the rocking member 2 is also positioned above and away from the cam member 27.

When a desired letter is to be printed by the printing device, current is caused to flow through the release coil 28 associated with the permanent magnet 5 corresponding to the desired or selected letter to thereby demagnetize the permanent magnet. Upon the demagnetization of the permanent magnet 5, the coiled spring 7 causes the rocking member 2 to pivot in the clockwise direction about the transverse shaft 1 to the two dotted-line position until the rocking member engages the cam member 27. As the rocking member 2 is pivoted in the above direction, the trigger hammer 4 pivoted on the rocking member descends into the rotation locus of the pawled wheel 20 to cause the undersurface of the trigger hammer to engage the projection 17 on the engaging member 18 whereby the engaging member yields resiliently to the two dotted-line position. As the engaging member 18 yields in the manner mentioned above, the pawl 19 on the rotating pawled wheel 20 strikes against the trigger hammer 4 which is then in the rotation locus of the wheel 20 and thus, the trigger hammer 4 pivots about the pin 3 in the clockwise direction against the force of the coiled spring 22. As the trigger hammer 4 pivots in the clockwise direction, the abutment 15 on the trigger hammer 4 strikes against the hammering member 12 which in turn pivots in the clockwise direction about the shaft 10 against the force of the coiled spring 13. As the hammering member 12 pivots in the clockwise direction, the striking portion 11 of the hammering member 12 strikes against the printing drum 9 with the ribbon 25 and paper sheet 24 interposed therebetween to thereby effect the printing operation in cooperation with the drum. After the printing operation, although the trigger hammer 4 reverses its movement direction to pivot in the counter-clockwise direction, since the engaging member 18 returns to its initial position as shown with the full line by its inherent resiliency immediately after the trigger hammer 4 has pivoted in the clockwise direction for effecting the previous printing operation, the projection 17 on the engaging member 18 engages in the recess 16 in the trigger hammer 4 which is now pivoting in the counter-clockwise direction to prevent the trigger member from pivoting further in the counter-clockwise direction and maintain the trigger hammer out of the rotation locus of the pawled wheel 20. In this way, the pawled wheel 20 is effectively prevented from causing the trigger hammer 4 to strike against the hammering member 12 twice in a single printing operation which will result in super-imposed printing.

After the printing operation, as the feed mechanism 26 operates to intermittently feed the paper sheet 24 and ribbon 25 together, the cam member 27 which operates in synchronization with the feed mechanism 26 rotates to cause the rocking member 2 to pivot in the counter-clockwise direction about the transverse shaft 1 towards the permanent magnet 5 against the force of the coiled spring 7. By this time, the flow of current to the release coil 28 has been interrupted to return the permanent magnet 5 to its excited condition to allow the magnet to attract the rocking member 2 thereto and thus, the rocking member 2 is held in position by the attraction of the permanent magnet 5. Simultaneously, the recess 16 in the trigger hammer 4 is disengaged from the projection 17 on the engaging member 18 to allow the trigger hammer to return to the initial position as shown with the full line.

As appreciated from the foregoing description of the preferred embodiment of the invention, according to the present invention, when the printing device is not operated, the rocking member 2 is normally held on the permanent magnet 5 by the attraction of the magnet so as to maintain the trigger hammer 4 out of the rotation locus of the pawled wheel 20. When the printing device is operated, the permanent magnet 5 is demagnetized to allow the rocking member 2 to pivot away from the magnet by the force of the coiled spring 7 and at the same time, the trigger hammer 4 pivoted to the rocking member 2 pivots in the clockwise direction about the pin 3 until the lower end of the trigger hammer engages the continuously rotating pawled wheel 20. Upon the engagment of the pawled wheel 20 by the trigger hammer 4, the wheel delivers a striking force to the trigger hammer 4 by the pawl 19 of the wheel to cause the trigger hammer to strike against the hammering member 12 which in turn pivots in the clockwise direction about the transverse shaft 10 in opposition to the force of the coiled spring 13 to strike against the printing drum 9 to thereby effect the printing operation. Since the trigger hammer 4 normally does not engage the continuously rotating pawled wheel 20 and is stationary, the various parts of the writing device are prevented from engaging and contacting each other to thereby eliminate or minimize the possibility of wear on the parts and/or noise. After the printing operation, while the rocking member 2 is being pivoted in the counter-clockwise direction about the shaft 1 towards the permanent magnet 5 by the intermittently rotating cam member 27, the permanent magnet 5 is returned to its excited condition to attract the rocking member 2 to the magnet. According to the present invention, since the permanent magnet 5 may be a magnet having a relatively low magnetic force, the permanent magnet may have a relatively low capacity which makes the entire writing device compact and reduces the production cost of the device. Furthermore, since the rocking member 2 is pivoted away from the permanent magnet 5 by the force of the coiled spring 7 as the magnet is demagnetized and the thus pivoting rocking member delivers a striking force to the trigger hammer and accordingly, to the hammering member by means of the pawled wheel rotating continuously at a high speed, the printing operation can be effected at a high speed. After the printing operation, since the trigger hammer is moved and maintained out of the rotation locus of the continuously rotating pawled wheel, the pawled wheel is effectively prevented from causing the trigger hammer to strike against the hammering member twice in a single printing operation which will result in super-imposed printing.

While only one embodiment of the invention has been shown and described in detail, it will be understood that the same is for illustration purpose only and not to be taken as a definition of the invention, reference being had for the purpose to the appended claims.

What is claimed is:

1. A printing device comprising in combination a. a driven rotatable print drum having a plurality of raised type faces arranged circumferentially at spaced intervals thereon;

b. printing hammer means rotatably mounted for rotation around an axis parallel with the axis of rotation of said print drum, to abut against and move away from the respective type faces on said drum;

c. rocking means one end of which is rotatably mounted for rotation around an axis parallel with the axis of rotation of said drum and having a portion opposed to said printing hammer;

d. bias means resiliently biasing said rocking member in a direction toward said printing hammer;

e. magnetic means adjacent said rocking means for attractively holding said rocking member against the bias of said bias means in a normal position and releasing said rocking member to the control of said bias means when said magnetic means is demagnetized;

f. actuator means rotatably mounted on said portion of said rocking means for rotation about an axis parallel with the axis of rotation of said print drum, said actuator means having therein an abutment spaced from said printing hammer means when said rocking means is attractively held by said magnetic means, and having an engaging member thereon which can be engaged for preventing rotational movement of said actuator means;

g. intermittently rotatable cam means disposed adjacent said rocking means for engaging said rocking means and moving said rocking means toward said magnetic means;

h. a ratchet wheel rotatably mounted for rotation around an axis parallel with the axis of rotation of said print drum and having an abutment thereon engageable with said actuator means when said rocking means is moved away from said magnetic means, said ratchet wheel pivoting said actuator means against said printing hammer means for causing said printing hammer means to strike the type on said print drum when said actuator means is operatively engaged by the abutment on said ratchet wheel; and k. detent means adjacent said engaging member on said actuator means for engaging said engaging member at the end of the pivoting movement of said actuator means for holding said actuator means out of the rotational orbit of said abutment on said ratchet wheel, and for releasing said engaging member upon the movement of said rocking means by said cam means toward said magnetic means.

* * * * *